US006247636B1

(12) United States Patent
Sun

(10) Patent No.: US 6,247,636 B1
(45) Date of Patent: Jun. 19, 2001

(54) HOLLOW GOLF CLUB HEAD AND METHOD FOR MANUFACTURE

(76) Inventor: Donald J. C. Sun, No. 4, Young-Kung Rd., Yong Ann Ind., Dist. Young Ann Hsiang (TW)

( * ) Notice: Subject to any disclaimer, the term of this patent is extended or adjusted under 35 U.S.C. 154(b) by 0 days.

(21) Appl. No.: 09/251,136

(22) Filed: Feb. 16, 1999

(51) Int. Cl.[7] ..... B23K 31/00; A63B 53/04

(52) U.S. Cl. ..... 228/135; 228/138; 228/175; 273/78; 473/324

(58) Field of Search ..... 228/135, 138, 228/175; 273/78; 473/329, 345, 324

(56) References Cited

U.S. PATENT DOCUMENTS

| | | | | |
|---|---|---|---|---|
| Re. 35,955 | * | 10/1998 | Lu | 473/329 |
| 4,438,931 | | 3/1984 | Motomiya . | |
| 4,750,537 | * | 6/1988 | Green | 144/363 |
| 5,024,437 | * | 6/1991 | Anderson | 273/78 |
| 5,094,383 | | 3/1992 | Anderson . | |
| 5,205,561 | * | 4/1993 | Lux | 273/186.2 |
| 5,232,224 | * | 8/1993 | Zeider | 273/167 H |
| 5,362,055 | * | 11/1994 | Rennie | 273/167 H |
| 5,362,056 | | 11/1994 | Rennie . | |
| 5,378,295 | * | 1/1995 | Yamashita et al. | 148/654 |
| 5,518,240 | * | 5/1996 | Igarashi | 473/345 |
| 5,720,674 | * | 2/1998 | Galy | 473/345 |
| 5,788,584 | * | 8/1998 | Parente et al. | 473/290 |
| 5,816,927 | * | 10/1998 | Taylor | 473/131 |
| 6,074,310 | * | 6/2000 | Ota | 473/345 |

FOREIGN PATENT DOCUMENTS

| | | | | |
|---|---|---|---|---|
| 2115294A | * | 9/1983 | (GB) | 150/160 |

* cited by examiner

*Primary Examiner*—Patrick Ryan
*Assistant Examiner*—L. Edmondson
(74) *Attorney, Agent, or Firm*—Edward A. Sokolski

(57) ABSTRACT

A golf club head is formed from two separate pieces. One of such pieces constitutes the face plate while the other piece constitutes the sole plate and the top crown of the club head. The pieces are welded together to form a hollow shell. The sole plate and the top crown are connected together with a hinge. These hinged pieces are joined in a closed position in a nest die and spot welded together. The face plate is then seam welded to the sole plate and the top crown in an argon chamber to form an integral unit.

7 Claims, 4 Drawing Sheets

HOLLOW GOLF CLUB HEAD AND METHOD FOR MANUFACTURE

BACKGROUND OF THE INVENTION

1. Field of the Invention

This invention relates to a golf club head and more particularly to such a head having a hollow configuration and its method of manufacture from three pieces constituting the face place, the sole plate and top crown plate.

2. Description of the Related Art

The formation of driver golf club heads in a hollow configuration is well known in the art. In many instances, the crown, sole and face plates of the club are formed separately and these separate pieces welded together to form the head. Such prior art clubs are described in U.S. Pat. No. 5,378,295 issued Jan. 3, 1995 to Yamashita et al, U.S. Pat. No. 4,438,931 issued Mar. 24, 1984 to Motomiya, and U.S. Pat. No. 5,362,055 issued Nov. 8, 1994 to Rennie. The present invention is an improvement over such prior art devices and methods of manufacture in providing a simplified method of fabricating a hollow golf club head from forged titanium parts having improved characteristics which can be economically mass-produced.

SUMMARY OF THE INVENTION

The device and method of the present invention is an improvement over the prior art in that it provides a simpler more economical fabrication which is conducive to mass production. Further, in the preferred embodiment, the face plate is made of a forged titanium alloy having a dish-in configuration which makes for a more solid and spring-back effect at impact with the ball.

The head is formed from two forged titanium pieces which are welded together to form a hollow configuration. One of these pieces consists of the neck, the hitting face, the toe and the heel portion and has a curved outer periphery edge. This piece is forged, preferably from titanium, in a unitary body having the desired weight distribution. The other of these pieces forms the top crown and sole plate of the head and is forged in one piece in the form of an open shell having a bridging hinge interconnecting the top crown and the sole plate. These two pieces are rotated together on the joining hinge with their peripheral edges abutting against each other and spot welded together to form a unitary piece. The face plate is then seam welded to the edges of the piece forming the top crown and sole plate to form an integral unit.

It is therefore an object of this invention to provide an improved method for fabricating a golf club head.

It is a further object of this invention to provide an improved golf club head which lends itself to simpler and more economical fabrication.

Other objects of the invention will become apparent in view of the following description taken in connection with the accompanying drawings.

DETAILED DESCRIPTION OF THE INVENTION

Figure 1:
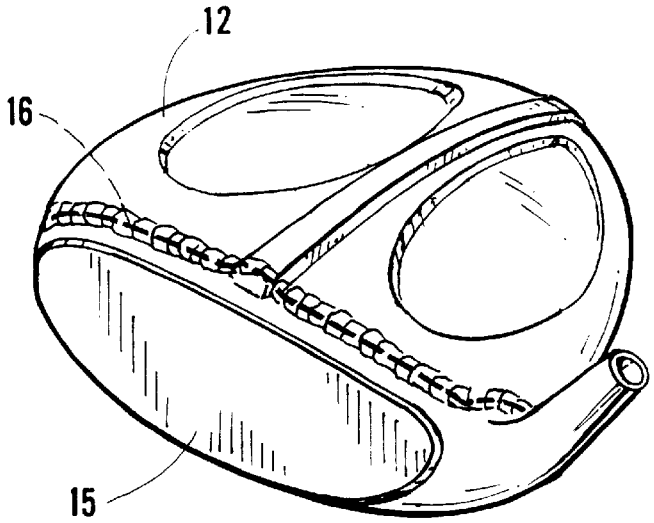
FIG. 1 is a top front perspective view of a preferred embodiment of the invention.
Figure 2:
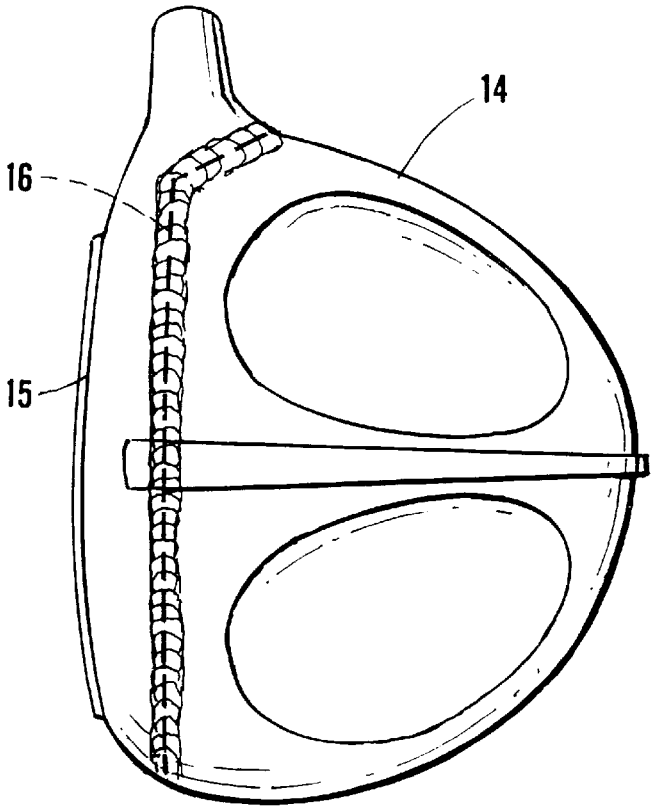
FIG. 2 is a bottom plan view of the preferred embodiment.

Referring now to FIGS. 1 and 2, a fully assembled head of the invention is illustrated. The top crown 12 is welded to the sole plate 14, as to be explained further on in the specification, and the face plate 15 seam welded at 16 to the peripheral edge of the integral piece formed by the top crown and sole plate.

Figure 3:
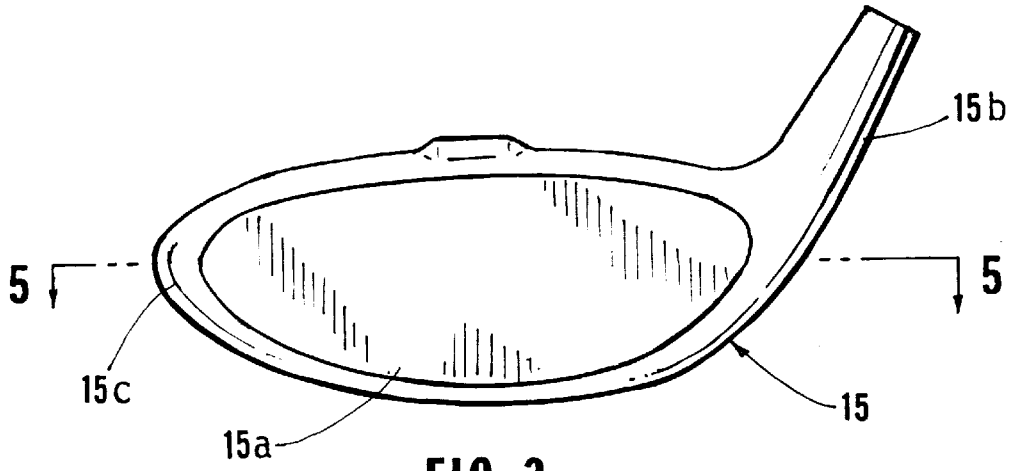
FIG. 3 is a front plan view of the face plate piece of the preferred embodiment.
Figure 4:
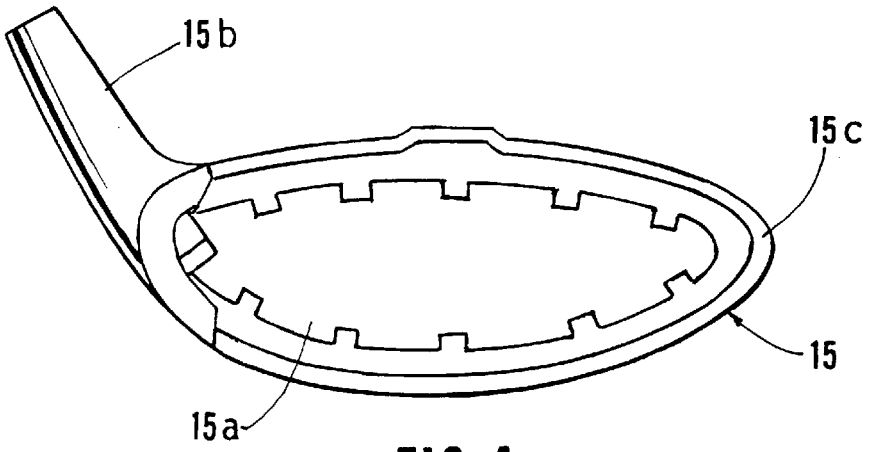
FIG. 4 is a rear plan view of the face plate piece of the preferred embodiment.
Figure 5:
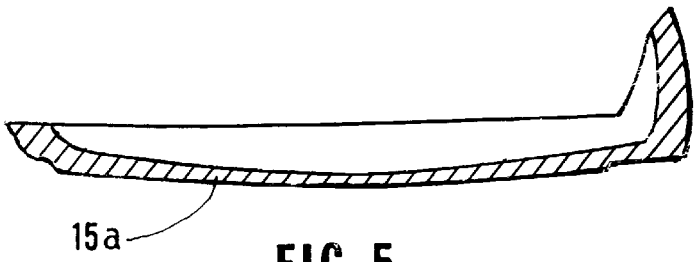
FIG. 5 is a cross sectional view taken along the plane indicated by 5—5 in FIG. 3.

Referring now to FIGS. 3–5, Front face piece 15 which includes face plate 15*a*, neck portion 15*b* and toe portion 15*c* is fabricated by hot forging from a high impact titanium alloy such as 6-4 titanium alloy(6% Al, 4% validium and 90% titanium). As shown in FIG. 5, the face plate has a "dish-in" or concave construction with the central portion being thicker than the end portions. This tends to make for a spring back effect which makes for greater distance. Corner ribs 15*d* provide reinforcement which tends to provide a solid impact and straight shots even with off center hits.

Figure 6:
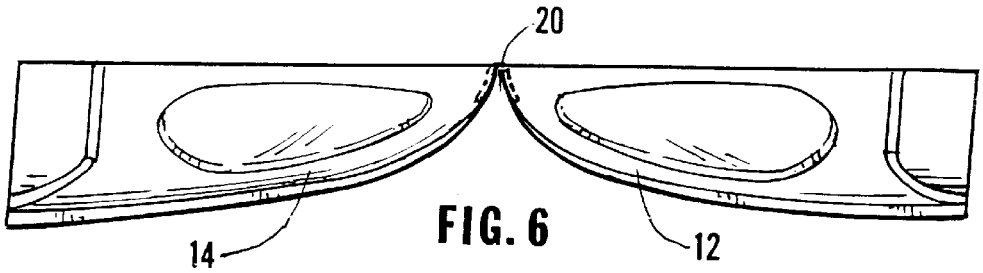
FIG. 6 is a side elevational view showing the top crown and sole plate piece in its open position and facing upwardly.
Figure 7:
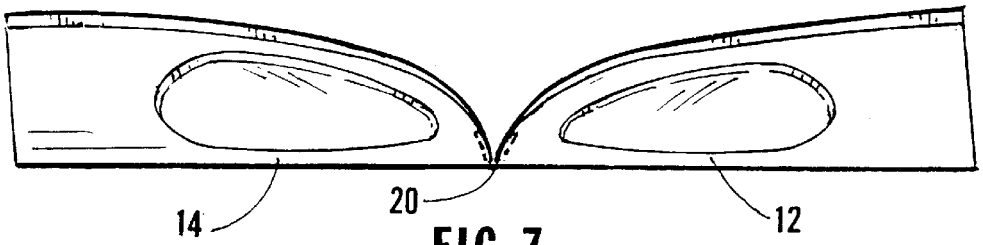
FIG. 7 is a side elevational view showing the top crown and sole plate piece in its open position facing downwardly.

Referring now to FIGS. 6 and 7, the top crown and sole plate piece is shown in its hinged open position. The sole plate 14 is joined to the top crown by means of a bridging hinge 20. This piece is of forged titatnium or titanium alloy.

Figure 8:
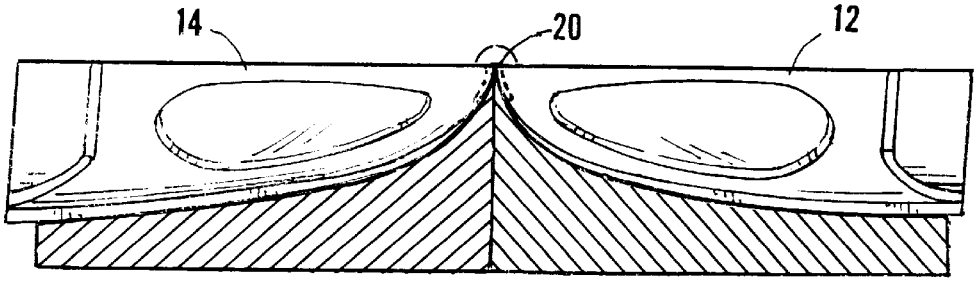
FIG. 8 is a cross sectional view showing the open piece of FIG. 6 set in a nest die.
Figure 9:
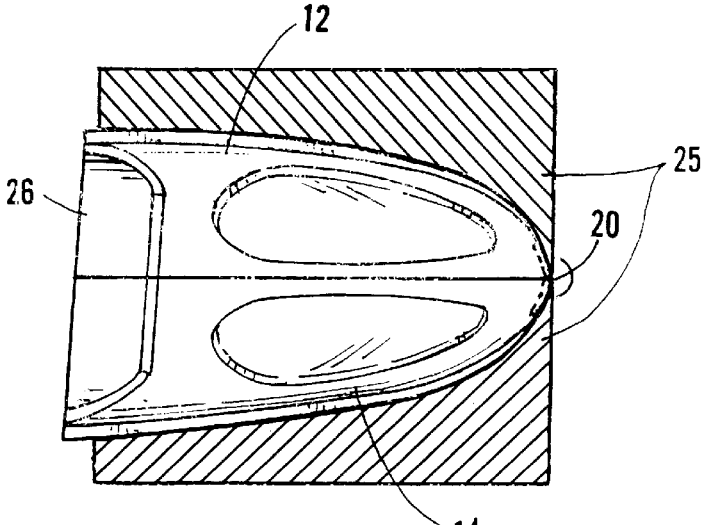
FIG. 9 is a cross sectional view showing the piece of FIG. 8 in a nest die in the closed position.

The top crown is joined to the sole piece by placing the unit in a nest die 25, as shown in FIG. 8 and then bringing the nest die and the unit to a closed position, as shown in FIG. 9 with the opposing peripheral edges of the top crown and sole plate in abutment against each other. The two sections are then spot welded together to form a shell with an open end 26 to which the face plate can be attached.

Figure 10:
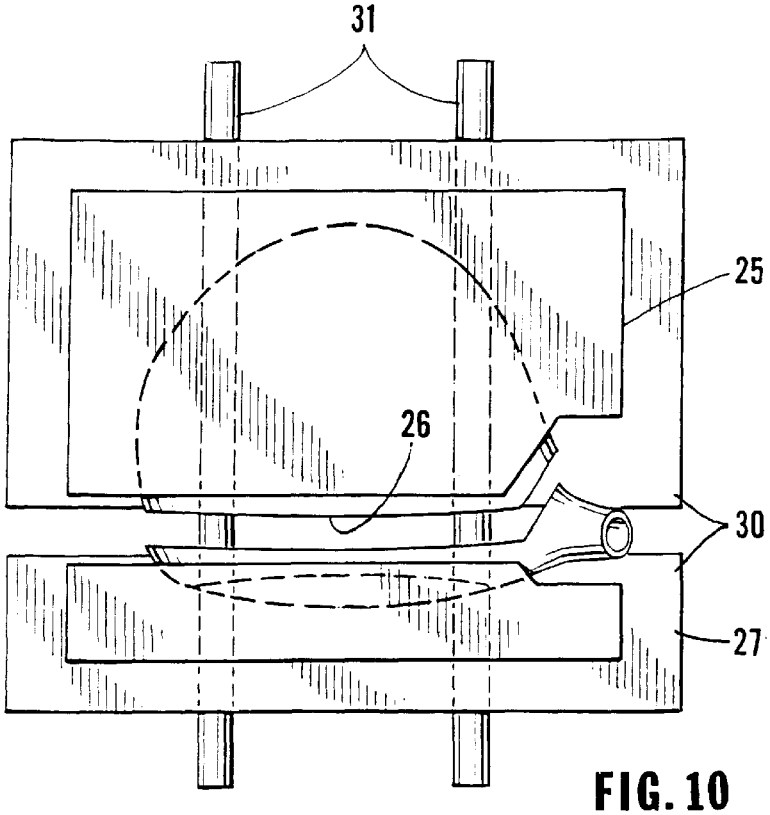
FIG. 10 is a top plan view illustrating the joinder of the face plate piece and the crown and sole plate piece together in their respective nest dies.
Figure 11:
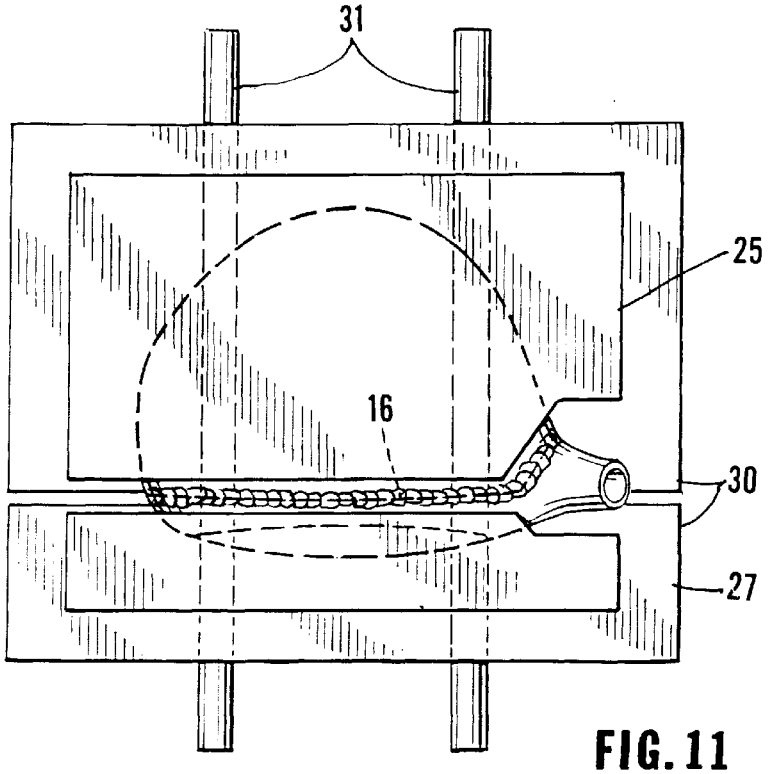
FIG. 11 is a top plan view illustrating the seam welding together of the face plate and the crown and sole plate pieces.

Referring now to FIGS. 10 and 11, the face plate piece 15, now installed in the sole plate nest die 27, and the top crown-sole plate piece are joined together by installing their nest dies in a linear movement fixture 30 having tracks 31 along which the nest dies can be positioned. The two pieces are brought together with their opposing edges in abutment with each in precise alignment and seam welded together along line 16, as shown in FIG. 11.

While the invention has been described and illustrated in detail it is to be understand that this is intended by way of illustration and example only, the scope of the invention being limited by the terms of the following claims.

I claim:

1. A method for forming a golf club head comprising the steps of:

forging a face plate piece;

forging a top crown and sole piece with the top crown and sole being joined together by a bridging hinge;

bringing opposing edges of said top crown and sole piece together in abutment with each other by means of said hinge;

spot welding said top crown and said sole together along said edges to form a shell having an open end; and seam welding said face plate piece to the open ended shell formed by said top crown and sole piece along the edges of said open end.

2. The method of claim 1 wherein said top crown and sole piece are installed in a nest die prior to spot welding and spot welded in said die.

3. The method of claim 1 wherein prior to the seam welding of said face plate piece to said top crown and sole piece together, said pieces are installed in a linear movement fixture wherein they are precisely aligned with each other and their opposing edges to be joined together brought together.

4. A golf club head fabricated by the method of forging a face plate piece;

forging a top crown and a sole piece with the top crown and sole being joined together by a bridging hinge;

bringing opposing edges of said top crown and sole piece together in abutment with each other by means of said hinge;

spot welding said top crown and said sole together along said edges to form a shell having an open end; and seam welding said face plate piece to the open ended shell formed by said top crown and sole piece along the edges of said open end.

5. A golf club head fabricated by the method of claim 4 and further including installing said top crown and sole piece in a nest die prior to spot welding and spot welding said top crown and sole in said nest die.

6. A method for forming a golf club head comprising the steps of:

forging a face plate piece;

forging a top crown and sole piece with the top crown and sole being joined together by a bridging hinge;

bringing opposing edges of said top crown and sole piece together in abutment with each other by means of said hinge;

installing said top crown and sole piece in a nest die;

spot welding said top crown and said sole piece together in said nest die along said edges to form a shell having an open end; and seam welding said face plate piece to the open ended shell formed by said top crown and sole piece along the edges of open end.

7. A golf club head fabricated by the method of forging a face plate piece;

forging a top crown and a sole piece with the top crown and sole being joined together by a bridging hinge;

bringing opposing edges of said top crown and sole piece together in abutment with each other by means of said hinge;

installing said top crown and sole piece in a nest die;

spot welding said top crown and said sole together in said nest die along said edges to form a shell having an open end; and seam welding said face plate piece to the open ended shell formed by said top crown and sole piece along the edges of said open end.

* * * * *